United States Patent [19]

Nilsson et al.

[11] Patent Number: 5,054,217

[45] Date of Patent: Oct. 8, 1991

[54] HARD INSERT FOR ICE/SNOW CLEARING TOOL

[75] Inventors: Erik R. Nilsson, Sandviken; Per-Göran Sjödin, Valbo; Bo G. Tibäck, Borläange, all of Sweden

[73] Assignee: Sandvik AB, Sandviken, Sweden

[21] Appl. No.: 529,722

[22] Filed: May 29, 1990

Related U.S. Application Data

[63] Continuation of Ser. No. 173,596, Mar. 25, 1988, abandoned.

[30] Foreign Application Priority Data

Mar. 25, 1987 [SE] Sweden ..... 8701222-5

[51] Int. Cl.[5] ..... E01H 5/09; E02F 3/80

[52] U.S. Cl. ..... 37/244; 172/701.1; 299/86; 37/242 R

[58] Field of Search ..... 37/244, 141 R, 141 T, 37/142 R; 299/86, 91; 241/291, 292.1, 236, 185, 195

[56] References Cited

U.S. PATENT DOCUMENTS

| | | | |
|---|---|---|---|
| 2,796,102 | 6/1957 | Schmidt, Jr. | 241/291 |
| 3,493,268 | 2/1970 | Bower, Jr. | 299/86 |
| 4,227,744 | 10/1980 | Livesay | 299/91 X |
| 4,289,211 | 9/1981 | Lumen | 299/91 X |
| 4,784,517 | 11/1988 | Bergqvist | 37/141 R X |

FOREIGN PATENT DOCUMENTS

| | | | |
|---|---|---|---|
| 3401243 | 8/1984 | Fed. Rep. of Germany | 299/86 |

*Primary Examiner*—Edgar S. Burr
*Assistant Examiner*—Moshe I. Cohen
*Attorney, Agent, or Firm*—Burns, Doane, Swecker & Mathis

[57] ABSTRACT

An ice and snow scraping insert includes a cylindrical or slightly conical rear surface portion, a blunt front surface portion, and a smoothly curved transition surface portion interconnecting the front and rear surface portions. The rear surface portion defines an axial length and a diameter, the ratio (L/D) of which is from 0.3 to 0.7.

30 Claims, 4 Drawing Sheets

HARD INSERT FOR ICE/SNOW CLEARING TOOL

This application is a continuation of application Ser. No. 07/173,596, filed Mar. 25, 1988, abandoned.

BACKGROUND AND OBJECTS OF THE INVENTION

The present invention refers to a tool intended to be rotatably mounted in a cutter, said tool is in operative position carrying out ice-scraping and/or snow clearing of a road surface, and that the longitudinal axis of rotation of the tool forms an angle relative to the road surface in the range of 20° to 90°, and that a hard material tip of the tool contacts the road surface in operative position of the tool. The invention also refers to the hard material tip separately.

From Bergqvist et al U.S. Pat. No. 4,784,517 issued Nov. 15, 1988, it is previously known a cutter of the type mentioned above. The tools used with this cutter are of standard type, i.e., the same type of tools that are used for cutting asphalt or breaking coal, or the like. These tools are thus designed to carry out a cutting action and consequently a common feature is that the hard material insert has a relatively pointed design to minimize the cutting forces.

The tools to be used with a cutter for ice-scraping/snow clearing, however, must have other characteristics than the tools used for a road-cutting action. When a cutter armed with tools of the former type works the road surface a rolling contact will be established between the tool tips and the road surface. For that reason it is extremely important that the friction forces that arise between the hard material tips and the road surface provide a rotation of the tool. Also it is of great importance that the angle that the longitudinal axis of rotation of the tools forms relative to the road surface can be varied within rather wide ranges without affecting the function of the tool in any appreciable degree. It is also important that the volume of wear of the hard material tip is big so as to achieve a length of life that is acceptable.

The present invention has the aim of presenting a tool of the type mentioned above and having a hard material tip so designed that the characteristics mentioned above are achieved.

THE DRAWINGS

Below embodiments of the invention will be described, reference being made to the drawings, wherein.

DESCRIPTION OF PREFERRED EMBODIMENT OF THE INVENTION

Figure 2:
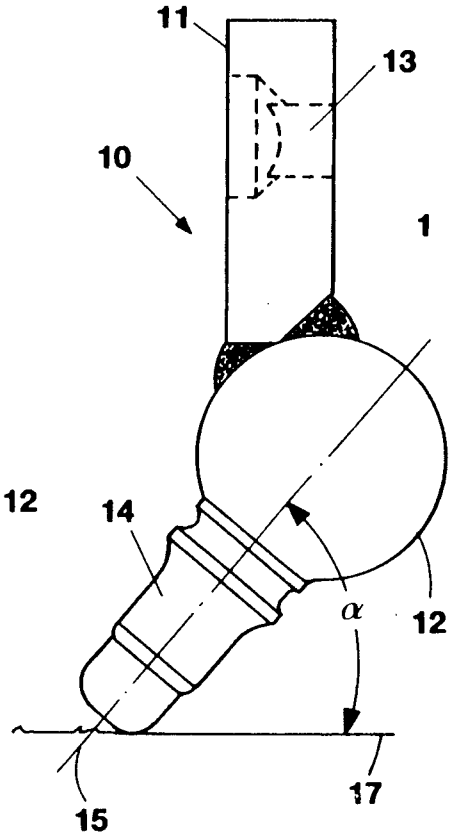
FIG. 2 shows a side view of the cutter according to FIG. 1.
Figure 1:
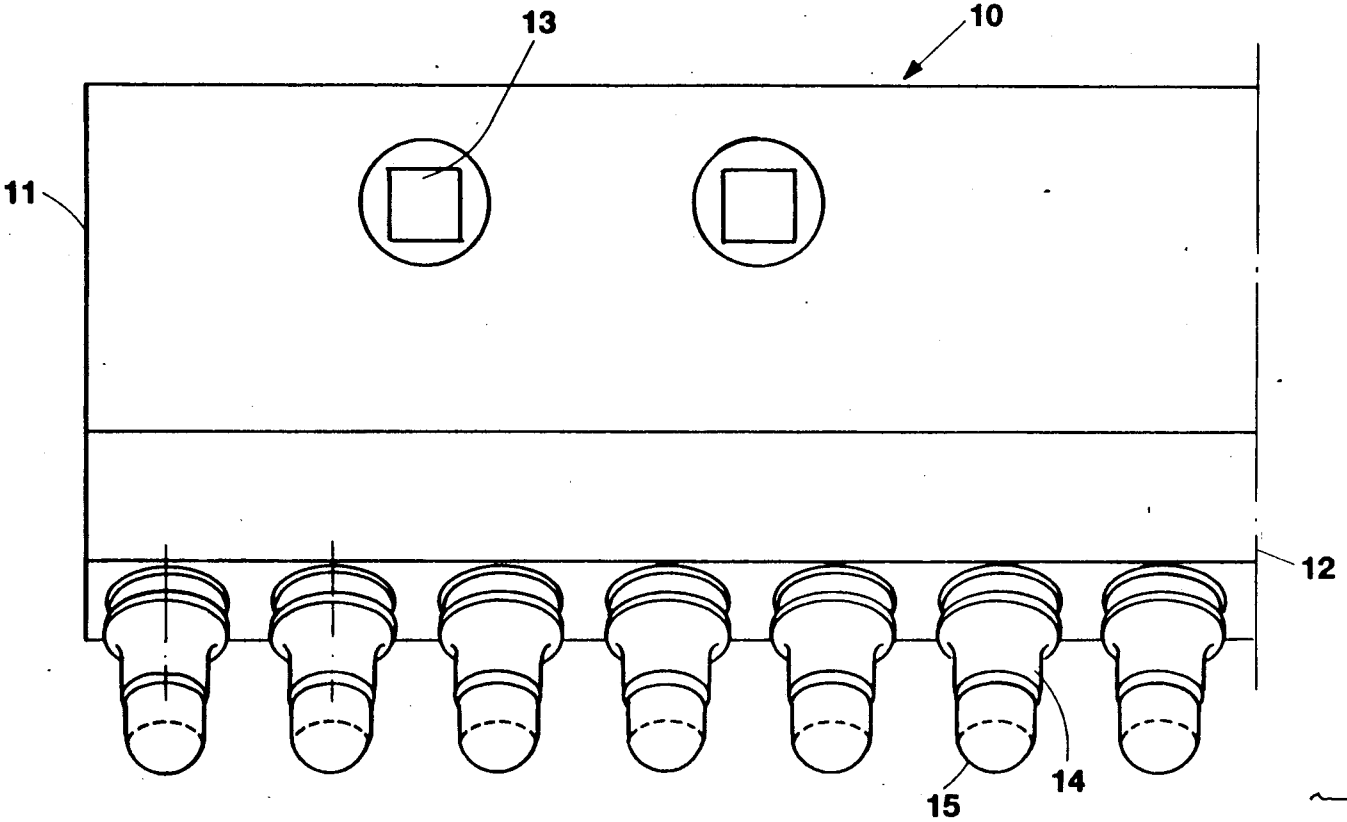
FIG. 1 shows a front view of a portion of a cutter armed with tools according to the invention.

The cutter disclosed in FIGS. 1 and 2 is generally denoted by 10 and includes a base member 11 and a holder body 12 welded thereto. The base member 11 is provided with through holes 13 that are intended to receive fastening means by which the holder body 12 is attached to a planing blade (not shown) on a machine for ice-scraping and/or snow clearing of roads.

A number of tools 14 are mounted in the holder body 12. The tools 14 have a material tip in accordance with the present invention.

The hard material tip 15 will be described more in detail with reference to FIG. 3.

The tip 15 is in a conventional way brazed to the tool 14 by having a projecting portion 18 received in a correspondingly designed recess 19.

Figure 3:
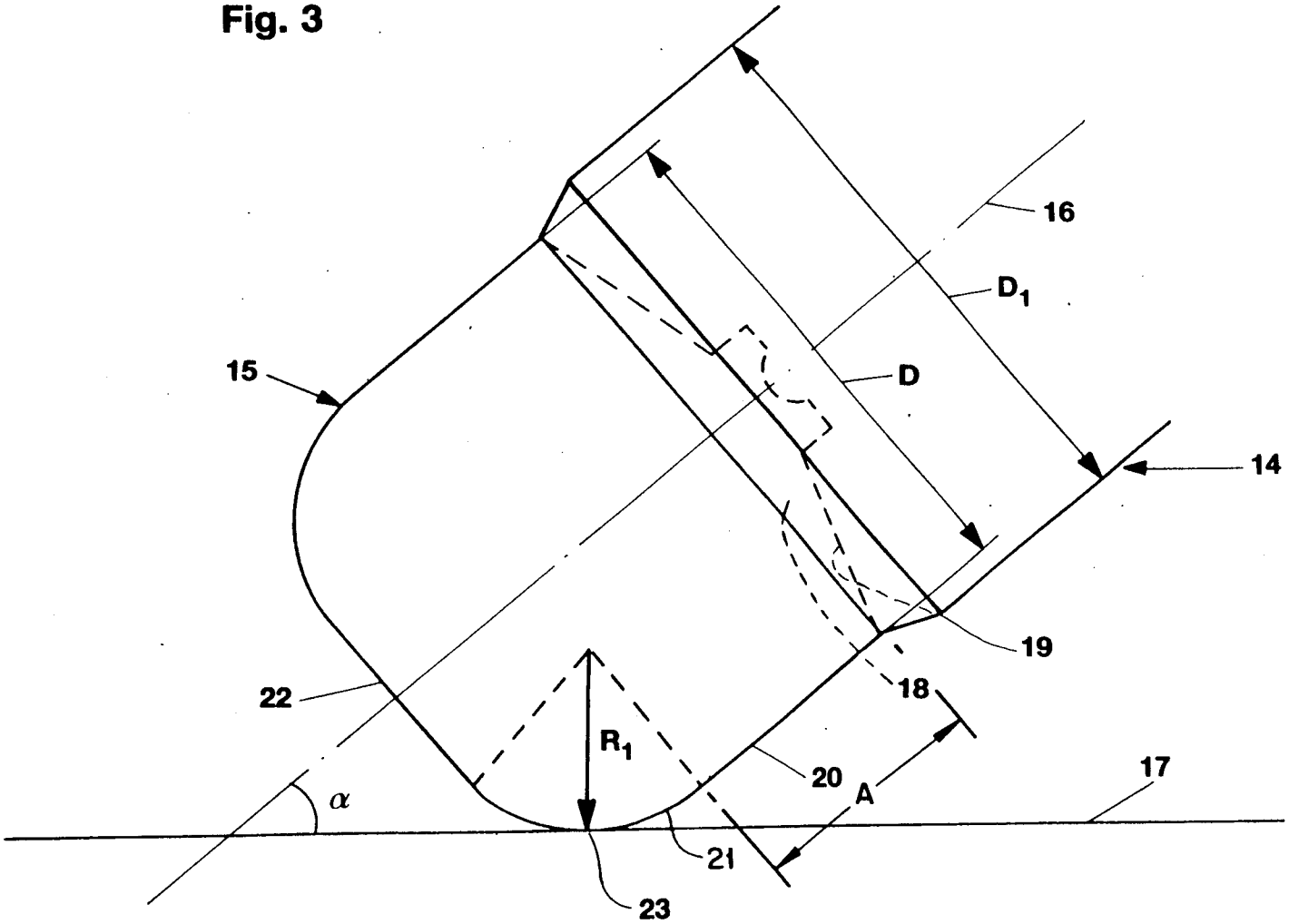
FIG. 3 shows an embodiment of a hard material tip of a tool according to the invention.

The hard material tip 15 in the embodiment according to FIG. 3 comprises a cylindrical portion 20 located nearest to the tool. In the area of the free end of the tip 15 the cylindrical portion is transferred into a shape-defining or transition surface 21 having a fixed radius of curvature $R_1$, in an axial plane through the axis 16 of rotation. The shape-defining surface 21 is in its turn transferred into a flat (blunt) front surface 22 that is oriented perpendicular to the axis of rotation 16 of the tool 14.

Due to the fact that the portion 20 of the hard material tip 15 that is located nearest to the tool 14 has a cylindrical shape the contact point 23 between the hard material tip 15 and the road surface 17 will be located relatively far away from the axis 16 of rotation. This means that a relatively lower force is needed to rotate the tool 14 around its axis 16 of rotation.

A characterizing feature of the hard material tip 15 according to the invention is that the diameter D of the cylindrical portion 20 only is slightly smaller than the diameter $D_1$ of the adjacent portion of the tool 14. The tip 15 thus holds a relatively great volume of hard material.

The location of the contact point 23 relative to the axis 16 of rotation depends on several factors. The above-mentioned relatively great volume of hard material is of course one factor as well as the radius of curvature of the shape-defining surface 21 and the inclination angle $\alpha$ of the axis 16 of rotation relative to the road surface 17.

Generally seen it is valid that the smaller the radius of curvature $R_1$ the further away from the axis 16 of rotation the contact point 23 will be located. However, it is also important that the radius $R_1$ be sufficiently large that the risk for penetration of the tip 15 into the road surface 17 is eliminated to the utmost possible extent.

In the embodiment according to FIG. 3 the ratio between the radius $R_1$ and the diameter D is about 1:3.

The angle $\alpha$ that the axis 16 of rotation has relative to the road surface 17 is preferably about 40°. One great advantage of the hard material tip 15 according to the invention is that the degree of freedom for variation of the angle $\alpha$ is high. This is at once realized by studying FIG. 3. When the angle $\alpha$ is increased the distance from the contact point 23 to the axis 16 of rotation is increased.

Figure 4:
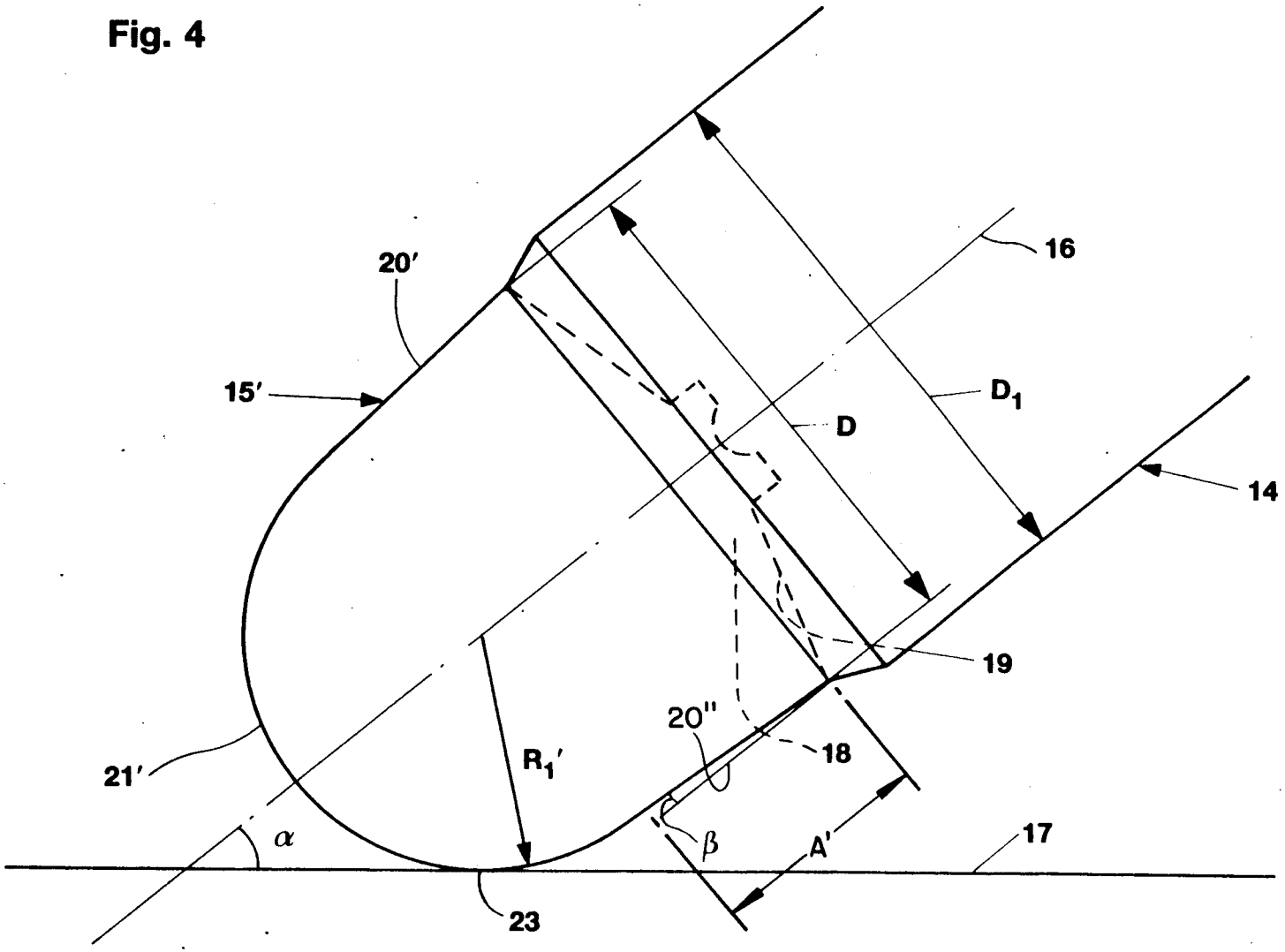
FIG. 4 shows an alternative embodiment of a hard material tip of a tool according to the invention.

The embodiment according to FIG. 4 of a hard material tip 15' according to the invention has a slightly conical rear surface portion 20' that replaces the cylindrical portion 20 of the embodiment according to FIG. 3. The conicity of the portion 20' is designated by $\beta$ and has the value of 5° in the disclosed embodiment. That angle $\beta$ is formed by the portion 20' and an imaginary cylindrical surface 20'' which is coaxial relative to the axis 16 and which intersects the portion 20'. This seems to be the upper limit for the parameter because otherwise negative effects concerning volume of hard material, readiness to rotate and degree of freedom for the angle $\alpha$ will occur.

The free end 21 of the hard material tip 15' according to FIG. 4 constitutes of a semi-sphere having the radius of curvature of $R_1'$. That end 21' defines both a transition surface and a blunt front surface. This design of the free end creates substantially the same advantages in respect of readiness to rotate and readiness to penetrate as the embodiment according to FIG. 3.

The radius of curvature $R_1'$ for the semi-sphere is in the disclosed embodiment somewhat smaller than half the diameter D.

Naturally the free end does not need to be exactly a semi-sphere but cap shape is equally conceivable.

Figure 5:
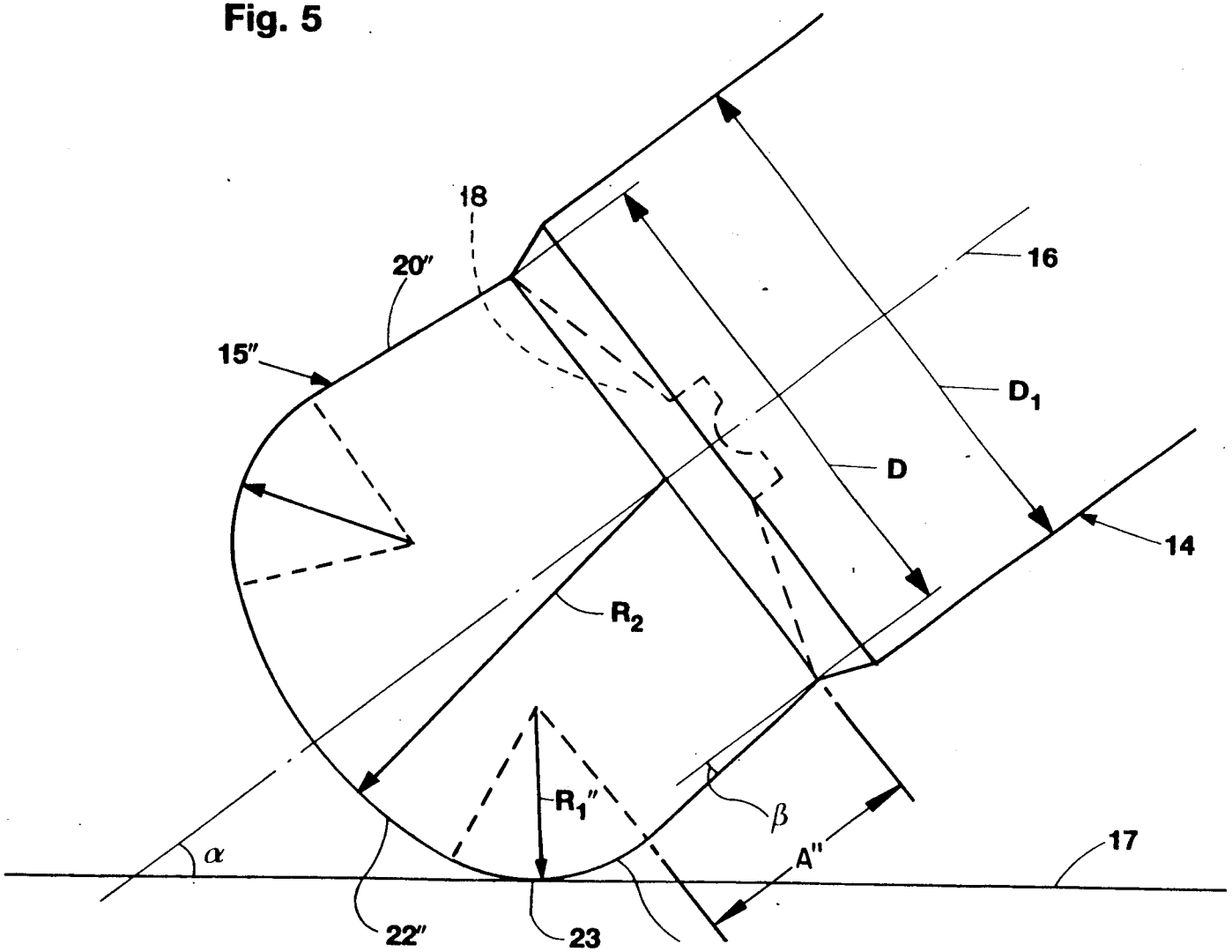
FIG. 5 shows a further alternative embodiment of a hard material tip of a tool according to the invention.

The embodiment according to FIG. 5 is characterized by the slightly conical rear portion 20'' that widens in direction towards the free end of the hard material tip 15'' that includes a first shape-defining or transition surface 21'' nearest to the conical portion 20'' having a radius of curvature $R_1''$ in an axial plane through the axis 16 of rotation and a blunt second shape-defining front surface 22'' having a radius of curvature $R_2$ in an axial plane through the axis 16 of rotation. The free end of the hard material tip 15'' is thus combined of shape-defining surfaces 21'', 22'' having different radii of curvature in an axial plane through the axis 16 of rotation. In the embodiment according to FIG. 5 the radius of curvature $R_2$ is essentially bigger than the radius of curvature $R_1''$.

The conicity of the portion 20'' is designated in FIG. 5 by $\beta$. A value for $\beta$ up to 5° seems preferable. Indeed the design according to FIG. 5 gives rise to a greater stress upon the brazed seam between the tip 15'' and the tool 14 but also a higher readiness to rotate and a greater volume to wear is achieved.

For all the described embodiments the hard material tip 15; 15'; 15'' is symmetric about the axis 16 of rotation. Also the cylindrical or slightly conical portion 20;20';20'' should have an axial extension A(FIG. 3); A(FIG. 4); A(FIG. 5) in the range of 0.25–0.7, preferably 0.35–0.45, times the diameter D of portions 20;20';20'' at the connection to the tool 14.

To sum up, a hard material tip 15; 15'; 15'' according to the present invention gives rise to essential advantages in ice-scraping and snow clearing. Apart from principally eliminating the risk of penetration into the road surface 17 a relatively small force is required to rotate the tool as well as a relatively greater volume to wear is achieved.

The invention is of course not in any way restricted to the embodiments described above but the different cylindrical and slightly conical portions can be combined with different types of free ends. Thus the invention can be varied freely within the scope of the appending claims.

We claim:

1. An ice and snow scraping tool adapted to be rotatably mounted in a road-clearing cutter, said tool comprising:

a tool blank defining a front-to-rear extending longitudinal axis about which said tool is adapted to rotate, and a hard tip mounted at a front end of said tool blank and including:

a generally cylindrical rear surface portion being coaxial with said axis and projecting forwardly from said front end of said tool blank, a blunt front surface portion, said front surface being flat and oriented perpendicular to said axis, and a smoothly curved transition surface portion interconnecting said front and rear surface portions, said cylindrical rear surface portion defining an axial length and a diameter, said axial length being from 0.3 to 0.7 times said diameter.

2. A tool according to claim 1, wherein said smoothly curved transition surface is radiused.

3. A tool according to claim 1 including a rearwardly tapering projection extending into a correspondingly shaped recess in said front end of said tool blank and bonded thereto.

4. A tool according to claim 1, wherein said axial length is at least 0.35 times said diameter.

5. An ice and snow scraping tool adapted to be rotatably mounted in a road-clearing cutter, said tool comprising:

a tool blank defining a front-to-rear extending longitudinal axis about which said tool is adapted to rotate, and a hard tip mounted at a front end of said tool blank and including:

a slightly conical rear surface portion being coaxial with said axis and projecting forwardly from said front end of said tool blank, a blunt front surface portion, and a smoothly curved transition surface portion interconnecting said front and rear surface portions, said rear surface portion defining an axial length and a diameter where said rear surface portion adjoins said tool blank, said axial length being from 0.3 to 0.7 times said diameter.

6. A tool according to claim 5, wherein said smoothly curved transition surface is radiused.

7. A tool according to claim 5, wherein said axial length is at least 0.35 times said diameter.

8. A tool according to claim 5 including a rearwardly tapering projection extending into a correspondingly shaped recess in said front end of said tool blank and bonded thereto.

9. A tool according to claim 5, wherein said rear surface portion tapers forwardly.

10. A tool according to claim 9, wherein the conicity of said rear surface portion relative to an imaginary cylindrical surface coaxial relative to said axis and intersecting said rear surface portion is no greater than five degrees.

11. A tool according to claim 9, wherein said front and transition surface portions are both defined by a semi-spherical surface.

12. A tool according to claim 9, wherein said rear surface portion tapers rearwardly.

13. A tool according to claim 12, wherein said rear surface portion defines a cone angle no greater than about ten degrees.

14. A tool according to claim 12, wherein said transition and front surface portions are defined by first and second radii, respectively, said first radius being shorter than said second radius.

15. A hard tip adapted to be fastened to a tool blank to form a rotatable ice and snow cutting tool, said tip formed of a hard material and comprising:

a generally cylindrical rear surface portion defining a longitudinal axis and adapted to project forwardly from the tool blank, a blunt front surface portion, said front surface portion being flat and oriented perpendicularly to said axis, a smoothly curved transition surface portion interconnecting said front and rear surface portions, and a rearwardly tapering projection extending rearwardly away from said rear surface portion and adapted to be secured to the tool blank, said slightly conical rear surface portion defining an axial length and a diameter, said axial length being from 0.3 to 0.7 times said diameter.

16. A hard tip according to claim 15, wherein said transition surface portion is radiused.

17. A hard tip according to claim 15, wherein said axial length is at least 0.35 times said diameter.

18. A hard tip adapted to be fastened to a tool blank to form a rotatable ice and snow cutting tool, said tip formed of a hard material and comprising:

a slightly conical rear surface portion defining a longitudinal axis and adapted to project forwardly from the tool blank, a blunt front surface portion, a smoothly curved transition surface portion interconnecting said front and rear surface portions, and a rearwardly tapering projection extending rearwardly away from said rear surface portion and adapted to be secured to the tool blank, said slightly conical rear surface portion defining an axial length and a rearmost diameter, said axial length being from 0.3 to 0.7 times said diameter.

19. A hard tip according to claim 18, wherein said smoothly curved transition surface is radiused.

20. A hard tip according to claim 18, wherein said smoothly curved transition surface is at least 0.35 times said diameter.

21. A hard tip according to claim 18, wherein said rear surface portion tapers forwardly.

22. A tool according to claim 21, wherein the conicity of said rear surface portion relative to an imaginary cylindrical surface coaxial relative to said axis and intersecting said rear surface portion is no greater than five degrees.

23. A hard tip according to claim 18, wherein said front and transition surface portions are both defined by a semi-spherical surface.

24. A hard tip according to claim 18, wherein said rear surface portion tapers rearwardly.

25. A tool according to claim 24, wherein the conicity of said rear surface portion relative to an imaginary cylindrical surface coaxial relative to said axis and intersecting said rear surface portion is no greater than five degrees.

26. A hard tip according to claim 24, wherein said transition and front surface portions are defined by first and second radii, respectively, said first radius being shorter than said second radius.

27. In an ice and snow clearing apparatus comprising a base fixedly mounted on a vehicle and a row of horizontally spaced tools mounted on and extending downwardly from said base to clear ice and snow from a road surface, the improvement wherein each of said tools comprises:

a tool blank defining a front-to-rear extending longitudinal axis, said tool blank mounted to said base for rotation relative to said base about said axis, said axis forming an angle of from twenty to ninety degrees with a road surface, and a hard tip mounted at a front end of said tool blank and including:

a generally cylindrical rear surface portion being coaxial with said axis and projecting forwardly from said front end of said tool blank, a blunt front surface portion, said front surface portion being flat and oriented perpendicular to said axis, and a smoothly curved transition surface portion interconnecting said front and rear surface portions, said cylindrical rear surface portion defining an axial length and a diameter, said axial length being from 0.3 to 0.7 times said diameter.

28. In an ice and snow clearing apparatus comprising a base fixedly mounted on a vehicle, and a row of horizontally spaced tools mounted on and extending downwardly from said base to clear ice and snow from a road surface, the improvement wherein each of said tools comprises:

a tool blank defining a front-to-rear extending longitudinal axis, said tool blank mounted to said base for rotation relative to said base about said axis, said axis forming an angle of from twenty to ninety degrees with a road surface, and a hard tip mounted at a front end of said tool blank and including;

a slightly conical rear surface portion being coaxial with said axis and projecting forwardly from said front end of said tool blank, a blunt front surface portion, and a smoothly curved transition surface portion interconnecting said front and rear surface portions, said rear surface portion defining an axial length and a diameter where said rear surface portion adjoins said tool blank, said axial length being from 0.3 to 0.7 times said diameter.

29. Apparatus according to claim 28, wherein said rear surface portion tapers forwardly.

30. Apparatus according to claim 28, wherein said rear surface portion tapers rearwardly.

* * * * *